US005088382A

United States Patent [19]

Goedecke et al.

[11] Patent Number: 5,088,382

[45] Date of Patent: Feb. 18, 1992

[54] LINEAR UNIT

[75] Inventors: Wolf-Dieter Goedecke, Unterkirnach; Victor Cohanciuc, Villingen-Schwenningen, both of Fed. Rep. of Germany

[73] Assignee: Mannesmann Aktiengesellschaft, Düsseldorf, Fed. Rep. of Germany

[21] Appl. No.: 644,986

[22] Filed: Jan. 23, 1991

[30] Foreign Application Priority Data

Jan. 24, 1990 [DE] Fed. Rep. of Germany ..... 4001938

[51] Int. Cl.[5] ..... F01L 25/08; F15B 13/00

[52] U.S. Cl. ..... 91/275; 91/335; 91/361; 91/459; 92/137; 137/625.64

[58] Field of Search ..... 91/465, 275, 323, 335, 91/361, 457; 92/137; 137/625.64, 625.69; 251/367

[56] References Cited

U.S. PATENT DOCUMENTS

| | | | |
|---|---|---|---|
| 4,002,103 | 1/1977 | Martin | 91/323 |
| 4,656,881 | 4/1987 | Goedecke et al. | 92/137 |
| 4,703,819 | 11/1987 | Hosotani | 91/459 |
| 4,718,454 | 1/1988 | Appleby | 137/625.64 |
| 4,748,897 | 6/1988 | Hoge et al. | 91/459 |
| 4,763,560 | 8/1988 | Sasaki | 91/361 |
| 4,932,311 | 6/1990 | Mibu et al. | 91/459 |

FOREIGN PATENT DOCUMENTS

| | | | |
|---|---|---|---|
| 2844545 | 4/1979 | Fed. Rep. of Germany | 137/625.69 |
| 7600866 | 8/1976 | Netherlands | 91/275 |

*Primary Examiner*—Edward K. Look
*Assistant Examiner*—Hoang Nguyen
*Attorney, Agent, or Firm*—Horst M. Kasper

[57] ABSTRACT

A linear unit (10) is provided with a cylinder (50) and a pressure-fluid actuated piston (52). The piston (52) runs in a borehole (51) of the cylinder (50). A slider (55) runs at the cylinder (50). A band (53) connects the piston (52) to the slider (55) and leads via deflection structure (54*a*, 54*b*) at the heads (11*a*, 11*b*) of the cylinder (50). Valves (15*a*, 15*b*) are screwed into the cylinder heads (11*a*, 11*b*) for feeding a pressure fluid to and discharging a pressure fluid from the borehole on two sides of the piston (52). The linear unit (10) provides an increased liberty of direction in a position-mounting of the linear cylinder heads (11*a*, 11*b*) and of the linear unit with valves (15*a*, 15*b*) as well as in the positioning of the connection terminal pieces. The linear unit (10) is flexible and is of modular construction and allows different types of device components to be flanged in the same position.

25 Claims, 4 Drawing Sheets

LINEAR UNIT

BACKGROUND OF THE INVENTION

1. Field of the Invention

The invention relates to a linear unit with a cylinder, a pressure-actuable piston running in a borehole of the cylinder, a slider running at the cylinder, a band connecting the piston to the slider and led via deflection means at heads of the cylinder, and with valves, screwed into the heads, for the feeding and discharging of pressure fluid in the borehole on two sides of the piston.

2. Brief Description of the Background of the Invention Including Prior Art

A linear unit of the above recited kind is known from the German Printed Patent Document DE-OS 3,741,425.

According to the known linear unit, the valves are inserted as valve cartridges into corresponding hollow spaces of the cylinder heads and are thus integrated into the linear axis.

According to a further German Printed Patent Document DE-OS 3,235,784, there is known a linear unit with a piston furnished with a piston rod. The valves are screwed from the outside, with the aid of a threaded connection piece, into a corresponding threaded borehole of the cylinder heads. Thus, the valves project radially outwardly relative to the cylinder head.

It is a disadvantage in these known linear units that, based on the cartridge-receiver borehole in a linear unit according to the German Printed Patent Document DE-OS 3,741,425, respectively in case of a threaded borehole in a linear unit according to German Printed Patent Document DE-OS 3,235,784, the type of construction of the valve to be screwed-in is already predefined, because conventional miniature valves, to be considered in this context, exhibit different outer diameters or, respectively, connection threads depending on the construction size in each case. Consequently, it is not possible, in connection with the known linear units, to employ different valves for one and the same linear unit, i.e. with an unchanged cylinder, piston and cylinder heads, depending on the requirements to the linear unit, without simultaneously having to change the construction of the cylinder head.

Furthermore, the known linear units have each the disadvantage that the electrical connection and the pressure-fluid connector, which is usually a pneumatic connection, are in each case rigidly predefined, i.e. by the final mounting position of the inserted or screwed-in valve, the circumferential position of the pressure-fluid connector and of the electronic connection is simultaneously predefined. Therefore, it is only possible, in connection with the known linear units, that these connections are directed and forward in a certain direction from the valves. On the other hand, the required cables and tubing have to be led to a central unit, for example, to a central unit of a manipulating system or of a robot system. The linear unit is a part of a such central unit. If this central unit is now disposed in the opposite direction, then the cable or, respectively, the tubing has to be bent from the fixed peripheral position, defined by the mounting position of the valve, into the opposite direction, and then led to the central unit. It is self-evident that this construction reduces the degree of freedom upon assembly of complex manipulating systems. This results in even more of a disadvantage, since it is often desired that such manipulating systems be of an extremely compact construction. Furthermore, due to the desired freedom of motion of such manipulating systems, it is undesirable that cables and tubing hang around and thus impair and limit the freedom of motion of such manipulating systems.

SUMMARY OF THE INVENTION

1. Purpose of the Invention

It is an object of the invention to provide a linear unit of the kind initially recited with further improvements, where a greater liberty of direction is provided both in the position-mounting of the linear cylinder heads of the linear unit with valves, as well as in the positioning of the connection terminal pieces.

It is another object of the invention to provide a flexible and compact linear unit, as required in manipulating robot and material-handling systems.

It is yet a further object of the present invention to provide a linear unit which is flexible and is of modular construction allowing different types of device components to be flanged in the same position.

These and other objects and advantages of the present invention will become evident from the description which follows.

2. Brief Description of the Invention

According to the present invention, there is provided for a linear unit with a cylinder. A pressure-fluid-actuated piston has two sides. A cylinder has cylinder heads and a borehole. The piston runs in the borehole of the cylinder. A slider runs at the cylinder. A band connects the piston to the slider and is guided via deflection means at the cylinder heads. Valves are screwed into the cylinder heads by way of swivelling screw fittings for supplying and discharging a pressure fluid into the borehole on the two sides of the piston. The swivelling screw fittings comprise a seat of the valve. At least one pressure-fluid connector branches off from the swivelling screw fitting.

The pressure-fluid connector can serve for supplying the pressure fluid. The pressure fluid can be compressed air.

An additional pressure-fluid connector can serve for discharging the pressure fluid. The additional pressure-fluid connector can be furnished with a throttle or with a sound absorber.

A switching box can be disposed at the cylinder and can be connected via an electrical supply cable and via a supply tubing to a central unit. The switching box can furnish an electrical power and can supply the pressure fluid to the valves.

In accordance with the invention, the valves are screwed into the heads by way of swivelling screw fittings or swivel joints. The swivelling screw fittings comprise a seat of the valve. At least one pressure-fluid connector branches off from the swivelling screw fittings.

The purpose of the invention is perfectly obtained based on this construction. Furnishing a swivelling screw fitting with an integrated pressure-fluid connector is associated with the advantage that the pressure-fluid connector can be rotated by 360 degrees around the longitudinal axis of the valve. Thereby, the pressure fluid conduit, which is particularly critical in this respect, can be directed in its discharge direction exactly such that it can be led to the central unit over the shortest possible path length. The use of the swivelling screw fitting with integrated valve seat is further associated with the advantage that the swivelling screw fitting serves simultaneously as an adapter. Said adapter can be screwed into the corresponding thread borehole of the cylinder heads with one single defined thread. On the other hand, the mounting of a plurality of valve types is possible. Thus, without a constructive change of the cylinder heads, it is possible, depending on the specific application of the linear unit, to employ different valves in that, as required, different valves are mounted onto the integrated seat of the swivelling screw fitting.

According to a preferred embodiment of the invention linear unit, the pressure-fluid connector serves for a pressure fluid supply.

This provision is associated with the advantage that, as already recited, the pressure-fluid tubing can be precisely directed and aligned, in particular, since the pressure-fluid tubing is particularly critical with respect to its limited flexibility.

According to a further preferred embodiment of the invention, a further pressure-fluid connector serves for the pressure-fluid discharge. Preferably, this pressure-fluid discharge is associated with a throttle or with a sound absorber. The furnishing of a throttle allows to set the driving speed of the piston and the furnishing of a sound absorber allows a low noise operation.

Finally, in a preferred embodiment of the invention, a switching box for the electronic supply and for the pressure-fluid supply of the valves is disposed at the cylinder. The switching box is connected via an electric connection cable as well as via a supply tubing with a central unit.

This feature is associated with the advantage that generally two valves of a linear unit can be connected with short tubing pieces and with short conduit pieces to the switching box. The switching box is advantageously disposed in the middle of the cylinder between the two cylinder heads. In this case, the swivelling screw fittings are directed in each case inwardly such that the tubing and cable connections in each case have to be only half as long as the length of the cylinder. Only one single supply tubing is then necessary for the supply of the complete linear unit or, two supply tubings are required in case of a collected discharge of the exhaust air, as well as one single electrical connection cable. Advantageously, either control orders for the valves can be transmitted directly via the connection cable or, alternatively, a start or a stop order can be transmitted for a control electronics of the valves, integrated in the switching box. The control electronics, upon receiving a start order, processes a predefined and entered control program. The switching box, disposed at the cylinder, is further associated with the advantage that it can contain, supply, and control display elements for the functioning control of the valves and/or control elements, such as proximity switches and the like. The recited advantages result overall in an extremely compact construction of the linear unit with a minimum of cable and tubing expenditures.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
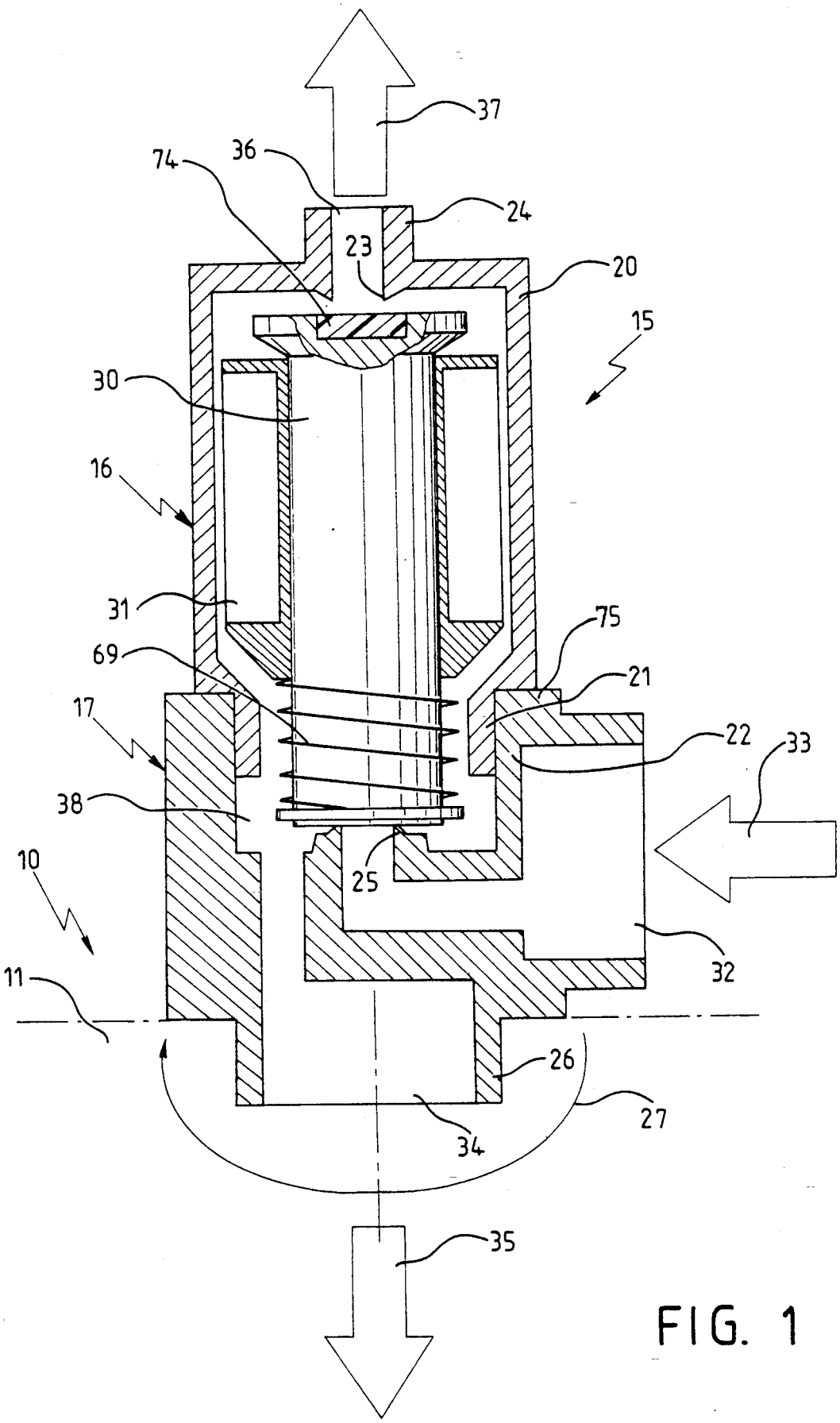
FIG. 1 is an in-part sectional view of a valve with a swivelling screw fitting, as it can be used in connection with the linear unit of the present invention.

The reference numeral 10 of the figures overall designates a linear unit of a conventional construction type, which is in each case furnished at its ends with a cylinder head 11.

The linear unit with a cylinder 50 comprises a pressure-fluid-actuated piston 52, running in a borehole 51 of a cylinder 50. A slider 55 runs at the cylinder 50. A band 53 connects the piston 52 to the slider 55 and is guided by a deflection means 54*a*, 54*b* at heads 11*a*, 11*b* of the cylinder 50. Valves 15*a*, 15*b* are screwed into the cylinder heads 11*a*, 11*b* for supplying or, respectively, discharging a pressure-fluid into the borehole 51 on two sides of the piston 52. The valves 15*a*, 15*b* are screwed by way of swivelling screw fittings 17*a*, 17*b* into the cylinder heads 11*a*, 11*b*. The swivelling screw fittings 17*a*, 17*b* comprise a seat 25 of the valve 15*a*, 15*b*. At least one pressure-fluid connector 32*a*, 32*b* branches off from the swivelling screw fitting 17*a*, 17*b*.

The pressure-fluid connector 32*a*, 32*b* can serve for supplying a pressure fluid.

An additional pressure-fluid connector 36 can serve for the discharge of the pressure fluid. The additional pressure-fluid connector 36, serving for a discharge of a pressure fluid, can be furnished with a throttle 57*a*, 57*b* or with a sound absorber 56*a*, 56*b*.

A switching box 60, for furnishing an electrical power and for furnishing a pressure fluid to the valves 15*a*, 15*b*, can be disposed at the cylinder 50. The switching box 60 can be connected via an electrical supply cable 65 as well as via a supply tubing 64 to a central unit 66.

FIG. 1 shows in this connection a valve 15, which can be screwed into the cylinder head 11. The valve 15 is subdivided into a cartridge part 16 as well as into a swivelling screw fitting 17.

The cartridge part 16 exhibits a casing 20, which is connected at its bottom side, by way of an upper rotary connector 21, to a corresponding rotary connector 22 of the swivelling screw fitting 17.

The casing 20 ends at its upper end in an upper valve seat 23, which is part of a flange 24. A lower valve seat 25 is integrated into the swivelling screw fitting 17.

The swivelling screw fitting 17 is connected via a lower rotary connector 26 to the cylinder head 11. It is understood that the rotary connectors 21, 22, 26 can be fixed by way of screw connectors, for example, screwed caps. However, for purposes of clarity, this is not entered in FIG. 1. Overall, the screw connectors 21, 22, and 26 open up the possibility to rotate the swivelling screw fitting 17, as indicated by the arrow 27, around the longitudinal axis of the valve 15 and, in fact, relative to the cartridge part 16 and to the cylinder head 11.

The cartridge part 16 comprises a closure member 30, formed as a movable magnet armature, which can be deflected by way of a magnet coil 31 in an axial direction and, in fact, against the force of a spring 69.

A first pressure-fluid connector 32 exits radially on the side from the swivelling screw fitting 17 and allows the inflow of a pressure fluid, for example, of compressed air, as indicated by the arrow 33. A second pressure-fluid connector 34 runs downwardly from the swivelling screw fitting 17 through the lower rotary connector 26 and allows to feed a pressure fluid into the cylinder head 11 or to discharge the pressure fluid from the cylinder head 11, as indicated by an arrow 35. Finally, third pressure-fluid connector 36 is formed by the already recited flange 24, in order to allow a discharge and venting of a pressure fluid, as indicated by the arrow 37.

According to the position of the closure member 30 illustrated in FIG. 1, the lower valve seat 25 is closed and the upper valve seat 23 is open. In this way, there is present a connection from the second pressure-fluid connector 34, via an annular space 38 around the lower valve seat 25, passing the magnet coil 31 upwardly to the third pressure-fluid connector 36. In this position of the valve 15, the conduit, not illustrated in FIG. 1, leading into the cylinder head 11, is thus vented from the cylinder bore of the linear unit 10.

If, however, the closure member 30 is deflected upwardly by actuation of the magnetic coil 31, then the upper valve seat 23 is closed and the lower valve seat 25 is open. In this position, the pressure fluid can enter into the valve 15 via the first pressure-fluid connector 32, and passes via the annular space 38 into the second pressure-fluid connector 34, in order to subject from there the recited cylinder borehole to pressure.

It can be clearly recognized from FIG. 1 that, in case of an unchanged orientation of the cartridge part 16 relative to the cylinder head 11, by rotation of the swivelling screw fitting 17 in the direction of the arrows 27, the peripheral position of the first pressure-fluid connector 32 can be varied by rotating the swivelling screw fitting 17. This means that a tubing, connected to the first pressure-fluid connector 32, can be led from any arbitrary circumferential position toward the valve 15.

Figure 2:
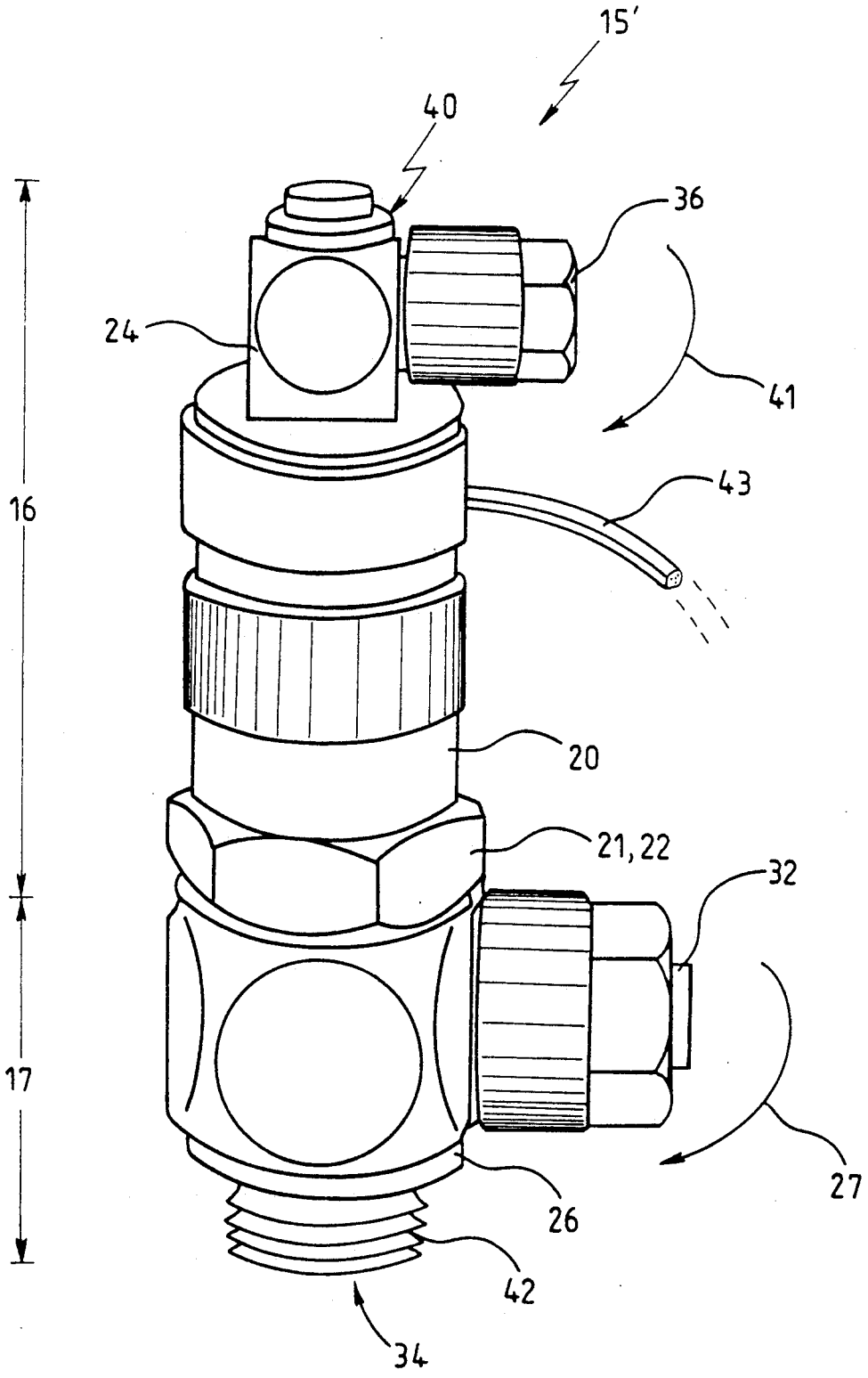
FIG. 2 is a schematic view of a valve similar to that of FIG. 1.

The construction type of the valve 15', illustrated in FIG. 2, corresponds completely to that of FIG. 1. In addition, however, it is provided that a further swivelling screw fitting 40 is connected at the flange 24 at the upper end of the casing 20, in order to allow a capturing of the exhaust air, and also in order to be able to connect a tubing for the discharge of the exhaust air from any desired circumferential position. This is possible because the swivelling screw fitting 40, as indicated by an arrow 41, can be swivelled relative to the casing 20.

FIG. 2 further illustrates a thread 42 at the bottom side of the valve 15'. This thread 42 serves for screwing the valve 15' into the cylinder head 11. The thread 42 can in this connection be a once defined thread such that the cylinder heads 11 of the linear unit 10 can all be furnished and equipped with the same counter thread. In contrast, the thread, present in the region of the upper rotary connectors 21, 22, can be formed differently for connecting the cartridge part 16 and the swivelling screw fitting 17, depending on the size of the cartridge part 16. The swivelling screw fitting 17 thus performs the function of an adaptor, in order to be able to use a different cartridge parts 16 at one and the same cylinder head 11 or, respectively, to be able to employ the one and the same counter thread 40 for the thread 42. This allows to equip one and the same linear unit 10 with different valves 15, depending on which cartridge part 16 is necessary for the respective application, in order to employ different valve types, for example, pressure servo valves or directional servo valves or other valve types, or also different valve sizes.

Finally, FIG. 2 illustrates a connection cable 43, which serves for the supplying of the magnet coil 31.

Figure 3:
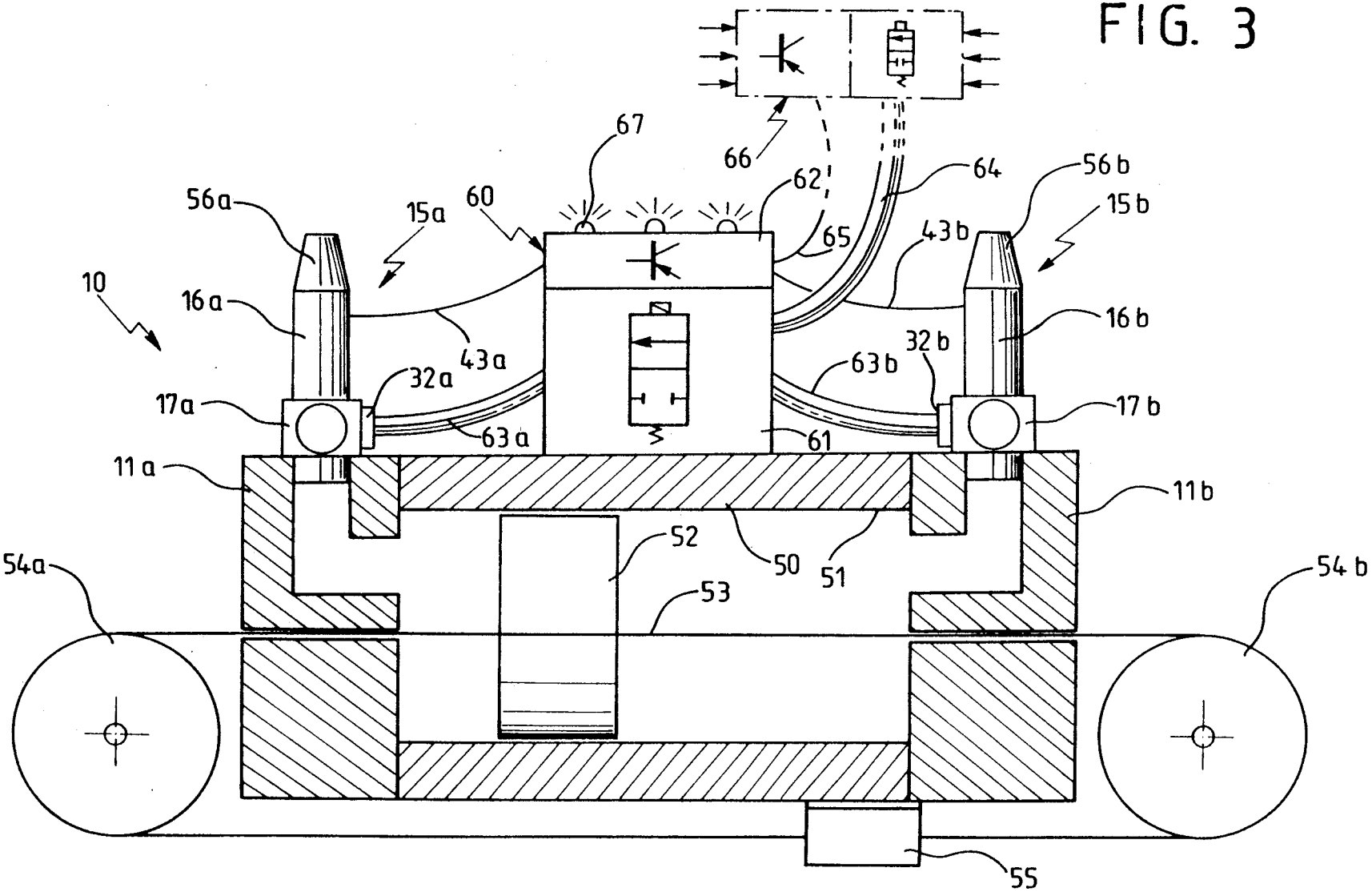
FIG. 3 is a schematic representation, partly in section, through an embodiment of an invention linear unit with two valves similar to the valves of FIGS. 1 and 2.

FIG. 3 illustrates a complete set-up of the linear unit 10.

A cylinder 50 exhibits a cylinder bore 51. A piston 52 runs in the cylinder bore 51. The piston 52 is connected at its two front faces with a flexible rope, band or the like. The band 53 is fed by way of a seal through the two cylinder heads **11*a*, 11*b*, and is guided by way of deflection means 54*a*, 54*b*, which can in particular be represented by rollers, again to the outside of the cylinder 50. At the outside of the cylinder 50, the band 53 is connected with a slider 55. This slider runs consequently in an opposite direction to the piston 52 at the outside of the cylinder 50**.

In addition, a switching box 60 is disposed at the outside of the cylinder 50, for example, at a position of half the axial length of the cylinder 50, which is illustrated only schematically in FIG. 3, but not necessarily retaining the relative dimensions.

The switching box 60 is subdivided into a pneumatic plane 61 and into an electric plane 62, where the pneumatic plane is the pneumatic control section of the linear unit. The pneumatic plane 61 is connected by way of short tubing pieces **63*a*, 63*b* to the first pressure-fluid connectors 32*a*, 32*b* of the valves 15*a*, 15*b*, which are screwed into the cylinder heads 11*a*, 11*b* in the above described way. For this purpose, the swivelling screw fittings 17*a*, 17*b* of the valves 15*a*, 15*b* are aligned and directed such based on rotation that, in each case, they are directed inwardly toward the switching box 60. In this way, the tubing pieces 63*a*, 63*b*** are as short as possible and are bent only by a minimum or normally, if at all.

The cables **43*a*, 43*b* are led from the valves 15*a*, 15*b* to the electrical plane of the switching box 60**.

It is necessary to guide only one single supply tubing 64 from the pneumatic plane 61 of the switching box 60 and only one single supply cable 65 from the electric plane 62 to a central unit 66. Two tubings instead of the tubings 63 and 64 are in each case only necessary if the exhaust air of the valves **15*a*, 15*b* has also to be captured and led away, as is the case in FIG. 2. According to the embodiment illustrated in FIG. 3, the valves 15*a*, 15*b* are, however, furnished with sound dampers and sound absorbers 56*a*, 56*b* such that a separate discharge of the exhaust air does not become necessary. In this context, the sound absorbers 56*a*, 56*b* act together with throttles 57, which are not illustrated in FIG. 3 but are schematically indicated in FIG. 4**.

The supply cable 65, running from the central unit 66 to the electric plane 62 of the switching box 60, can be used in different ways. For example, the supply cable 65 can contain supply voltages and as many veins as there are valves **15*a*, 15*b*** to be controlled and operated. In this way, an immediate and direct control of the valves 15*a*, 15*b* becomes possible from the central unit. Alternatively, a proper electronic control can, however, also be provided in the electric plane 62 of the switching box 60. The proper electronic control comprises a specific operating program for the valves 15*a*, 15*b* and has then to be started only by way of a start order and possibly stopped by way of a stop order. In this case, it would only be necessary to feed and provide the start order and the stop order via the supply cable 65.

The electric plane 62 of the switching box 60 can further be furnished with display means, for example, luminescent diodes 67, in order to indicate the operating state of the linear unit 10, for example, the switching state of the valves 15*a*, 15*b*.

Figure 4:
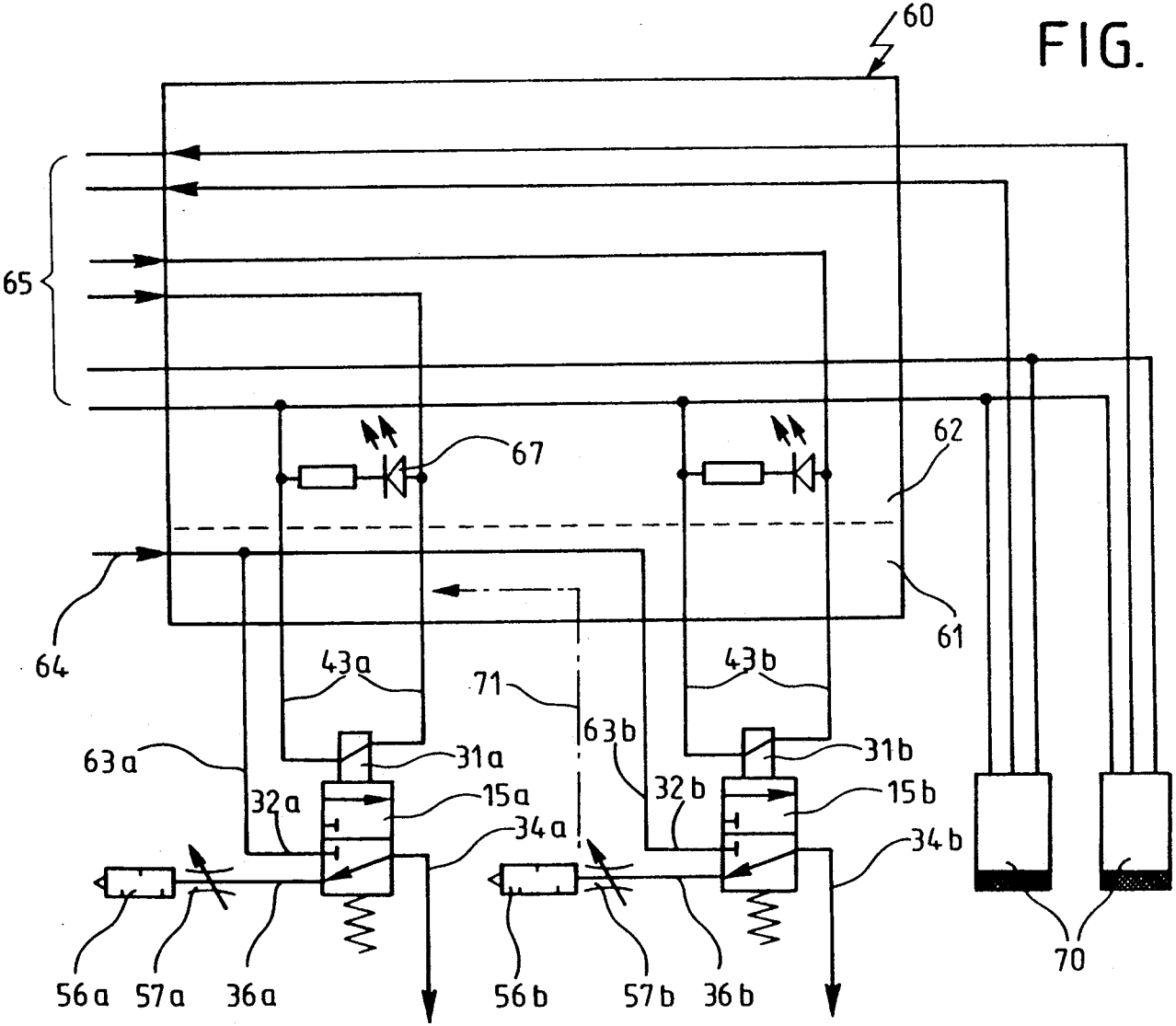
FIG. 4 is a schematic view, of a pneumatic and electrical switching circuit diagram for a switching box, as it can be employed in connection with a linear unit according to the embodiment of FIG. 3.

This becomes also clear from FIG. 4, where the electrical and pneumatic switch connections of the switching box 60 are illustrated for one exemplified embodiment.

In addition, proximity switches 70 can be recognized in FIG. 4. The proximity switches can be provided at the linear unit 10, in order to recognize end positions of the slider 55, and in order to avoid collisions of the linear unit 10 with other units of manipulating device. In this case, the proximity switches 70 are connected to the power supply of the valves 15*a*, 15*b*, and they deliver the measurement signal via the supply cable 65 to the central unit 66.

The pneumatic plane 61 of the switching box 60, as illustrated in FIG. 4, shows initially on the side of the pressure fluid the already recited throttles 57*a*, 57*b* at the third pressure-fluid discharge port 36*a* or, respectively, 36*b* of the valves 15*a*, 15*b*, which allow to set the drive speed of the piston 52.

In addition, sound absorbers 56*a*, 56*b* can be recognized downstream relative to the throttles 57*a*, 57*b*. Alternatively, the possibility of capturing the exhaust air and overall of discharging said exhaust air via the switching box 60 is indicated by dash-dotted line 71.

The armature is preferably furnished with a packing plate 74. The packing plate 74 serves to provide a seal to the valve seat 23 or, respectively, to the valve seat 25. The cartridge part 16 is preferably furnished with a screw connection 21 to the swivelling screw fitting 17. A stop 75 can be furnished at the swivelling screw fitting 17, where the cartridge part 16 shows the narrowing of the diameter at the position of attachment to the swivelling screw fitting 17. The narrowing of the end of the cartridge part 16, to be connected to the swivelling screw fitting 17, is associated with the advantage that it prevents contaminating material from entering the cartridge part 16. In addition, the magnet coil 31 can be maintained in a fixed position based on such a narrowing of the diameter at the end of the cartridge part 16 toward the swivelling screw fitting 17.

It will be understood that each of the elements described above, or two or more together, may also find a useful application in other types of linear units differing from the types described above.

While the invention has been illustrated and described as embodied in the context of a flexible and compact linear unit as employed in a manipulating or robot device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific asppects of this invention.

What is claimed as new and desired to be protected by Letters Patent is set forth in the appended claims:

1. A linear unit with a cylinder, comprising a pressure-fluid-actuated piston having two sides;

a cylinder having cylinder heads and a borehole, wherein the piston runs in the borehole of the cylinder;

a slider running at the cylinder;

a band connecting the piston to the slider and guided via deflection means at the cylinder heads;

valves screwed into the cylinder heads for supplying and discharging a pressure fluid into the borehole on the two sides of the piston;

swivelling screw fittings for screwing the valves into the cylinder heads;

a seat of the valve disposed in the swivelling screw fittings;

at least one pressure-fluid connector branching off from the swivelling screw fittings.

2. The linear unit according to claim 1, wherein the pressure-fluid connector serves for supplying the pressure fluid.

3. The linear unit according to claim 2, wherein the pressure fluid is compressed air.

4. The linear unit according to claim 2, further comprising an additional pressure-fluid connector, wherein the additional pressure-fluid connector serves for discharging the pressure fluid.

5. The linear unit according to claim 4, wherein the additional pressure-fluid connector is furnished with a throttle.

6. The linear according to claim 4, wherein the additional pressure-fluid connector is furnished with a sound absorber.

7. The linear unit according to claim 1, further comprising a switching box disposed at the cylinder and connected via an electrical supply cable and via a supply tubing to a central unit, wherein the switching box furnishes an electrical power and supplies the pressure fluid to the valves.

8. A linear unit with a cylinder (50), comprising a pressure-fluid-actuated piston (52), running in a borehole (51) of a cylinder (50);

a slider (55) running at the cylinder (50);

a band (53), connecting the piston (52) to the slider (55) and guided by a deflection means (54*a*, 54*b*) at heads (11*a*, 11*b*) of the cylinder (50);

valves (15*a*, 15*b*) screwed into the cylinder heads (11*a*, 11*b*) for supplying or, respectively, discharging a pressure-fluid into the borehole (51) on two sides of the piston (52), wherein the valves (15*a*, 15*b*) are screwed by way of swivelling screw fittings (17*a*, 17*b*) into the cylinder heads (11*a*, 11*b*), wherein the swivelling screw fittings (17*a*, 17*b*) comprise a seat (25) of the valve (15*a*, 15*b*), and wherein at least one pressure-fluid connector (32*a*, 32*b*) branches off from the swivelling screw fitting (17*a*, 17*b*).

9. The linear unit according to claim 8, wherein the pressure-fluid connector (32*a*, 32*b*) serves for supplying a pressure fluid.

10. The linear unit according to claim 9, wherein an additional pressure-fluid connector (36) serves for the discharge of the pressure fluid.

11. The linear unit according to claim 10, wherein the additional pressure-fluid connector (36), serving for a discharge of a pressure-fluid, is furnished with a throttle (57*a*, 57*b*).

12. The linear unit according to claim 10, wherein the additional pressure-fluid connector (36), serving for a discharge of a pressure, is furnished with a sound absorber (56*a*, 56*b*).

13. The linear unit according to claim 8, wherein a switching box (60), for furnishing an electrical power and for furnishing a pressure fluid to the valves (15*a*, 15*b*), is disposed at the cylinder (50), wherein the switching box (60) is connected via an electrical supply cable (65) as well as via a supply tubing (64) to a central unit (66).

14. The linear unit according to claim 1, wherein the cylinder includes a casing, which casing is connected at its bottom side, by way of an upper rotary connector, to a corresponding rotary connector of the swivelling screw fitting; further comprising an upper valve seat disposed at the upper end of the casing, wherein the upper valve seat is part of a flange; a lower valve, wherein the valve seat is integrated into the swivelling screw fitting;

a lower rotary connector connected to the swivelling screw fitting and to a lower cylinder head formed at the swivelling screw fitting for rotating the swivelling screw fitting around a longitudinal axis of the linear unit and relative to an upper cartridge part and to the cylinder head;

a bias spring;

a closure member formed as a movable magnet armature;

a magnet coil engaged by the bias spring and deflecting the closure member in an axial direction against the force of the bias spring.

15. The linear unit according to claim 1 further comprising a first pressure-fluid connector exiting radially on a side of the swivelling screw fitting and allowing an inflow of a pressure fluid toward the seat of the valve;

a lower rotary connector;

a second pressure-fluid connector running downwardly from the swivelling screw fitting through the lower rotary connector and allowing feeding of a pressure fluid toward a cylinder head;

a third pressure-fluid connector formed by an upper flange of a cartridge for discharging and venting of a pressure fluid;

wherein the closure member can assume a position of the lower valve seat being closed and the upper valve seat being open and alternatively the closure member can assume a position of the lower valve seat being closed and the upper valve seat being open, wherein the first recited position provides a connection from the second pressure-fluid connector via an annular space around the lower valve seat and passing the magnet coil upwardly to the third pressure-fluid connector such that the conduit leading into the cylinder head is thus vented from the cylinder bore of the linear unit in the first position of the valve and that where the closure member is deflected upwardly by actuation of the magnetic coil, then the upper valve seat becomes closed and the lower valve seat opens and the pressure fluid can enter into the valve via the first pressure-fluid connector and passes via the annular space into the second pressure-fluid connector in order to subject from there the recited cylinder borehole to pressure in this position of the valve.

16. The linear unit according to claim 1 further comprising a casing;

a flange disposed at the upper end of the casing;

a second swivelling screw fitting, wherein the second swivelling screw fitting is connected at the flange in order to allow a capturing of the exhaust air, and also in order to be able to connect a tubing for the discharge of the exhaust air from any desired circumferential position;

wherein the swivelling screw fitting is swivelled relative to the casing;

a thread disposed at the bottom side of the valve and serving for screwing the valve into the cylinder head;

a connection cable for supplying of the magnet coil with electrical power.

17. The linear unit according to claim 1 further comprising deflection means disposed on the outside relative to the cylinder;

a flexible rope fed through a seal and through the two cylinder heads and connecting the piston at its two front faces and wherein the flexible rope is guided by the deflection means and wherein the rope is connected at the outside of the cylinder with a slider;

wherein the slider runs in an opposite direction to the piston at the outside of the cylinder;

a switching box is disposed at the outside of the cylinder at a position of half the axial length of the cylinder, wherein the switching box is subdivided into a pneumatic plane and into an electric plane;

first fluid pressure connector attached to the valve, wherein the pneumatic plane is connected through short tubing pieces to the first pressure-fluid connectors, wherein the first fluid pressure connector is screwed into a head of the cylinder and wherein the swivelling screw fitting is directed inwardly toward the switching box such that the tubing pieces are short and bent only by a minimum angle;

a cable led from the valves to the electrical plane of the switching box.

18. The linear unit according to claim 17 wherein one single supply tubing is connecting the pneumatic plane of the switching box to a central unit and wherein only one single supply cable is connecting the electric plane to a central unit;

a sound absorber attached to the valve for sound absorbing and sound damping;

a throttle connected to the sound absorber;

an electroning control system furnished in the electric plane of the switching box, wherein the proper electronic control comprises a specific operating program for the valve; display means connected to the electric plane of the switching box for indicating the operating state of the linear unit.

19. The linear unit according to claim 1 further comprising a switching box furnishing electrical and pneumatic switch connections;

a power supply for the valve;

a proximity switch disposed at the linear unit for recognizing end positions of the slider and for avoiding collisions of the linear unit with other units of a manipulating device and wherein the proximity switch is connected to the power supply for the valves;

a supply cable connecting the proximity switch to the central unit for delivering the measurement signal top the central unit.

20. The linear unit according to claim 1 further comprising a switching box including a pneumatic plane; a pressure discharge port connected to the valve;

a throttle attached to the pressure discharge port for allowing to set the drive speed of the piston;

a sound absorber connected downstream relative to the throttle.

21. The linear unit according to claim 1 further comprising a packing plate attached to the armature for providing a seal to the valve seat;

a screw connection attached to the swivelling screw fitting;

a stop disposed at the swivelling screw fitting and wherein a narrowing of the diameter at the position of attachment to the swivelling screw fitting for preventing contaminating material from entering; and a magnet coil maintained in a fixed position based on such a narrowing of the diameter at the position of attachment in the area of the swivelling screw fitting.

22. The linear unit according to claim 1, wherein the pressure-fluid connector serves for supplying the pressure fluid, wherein the pressure fluid is compressed air;

an additional pressure-fluid connector, wherein the additional pressure-fluid connector is furnished with a throttle and with a sound absorber and serves for discharging the pressure fluid, a switching box disposed at the cylinder and connected via an electrical supply cable and via a supply tubing to a central unit, wherein the switching box furnishes an electrical power and supplies the pressure fluid to the valves.

23. The linear unit according to claim 8, wherein the pressure-fluid connector (32*a*, 32*b*) serves for suuplying a pressure fluid, wherein an additional pressure-fluid connector (36) is furnished with a throttle (57*a*, 57*b*) and with a sound absorber (56*a*, 56*b*) and serves for the discharge of the pressure fluid, wherein a switching box (60), for furnishing an electrical power and for furnishing a pressure fluid to the valves (15*a*, 15*b*), is disposed at the cylinder (50), wherein the switching box (60) is connected via an electrical supply cable (65) as well as via a supply tubing (64) to a central unit (66).

24. The linear unit according to claim 22, wherein the cylinder includes a casing, which casing is connected at its bottom side, by way of an upper rotary connector, to a corresponding rotary connector of the swivelling screw fitting;

a flange disposed at the upper end of the casing;

an upper valve seat disposed at the upper end of the casing, wherein the upper valve seat is part of the flange;

a lower valve, wherein the valve seat is integrated into the swivelling screw fitting;

a lower rotary connector connected to the swivelling screw fitting and to a lower cylinder head formed at the swivelling screw fitting for rotating the swivelling screw fitting around a longitudinal axis of the linear unit and relative to an upper cartridge part and to the cylinder head;

a bias spring;

a closure member formed as a movable magnet armature;

a magnet coil engaged by the bias spring and deflecting the closure member in an axial direction against the force of the bias spring;

a first pressure-fluid connector exiting radially on a side of the swivelling screw fitting and allowing an inflow of a pressure fluid toward the seat of the valve;

a lower rotary connector;

a second pressure-fluid connector running downwardly from the swivelling screw fitting through the lower rotary connector and allowing feeding of a pressure fluid toward a cylinder head;

a third pressure-fluid connector formed by an upper flange of a cartrige for discharging and venting of a pressure fluid;

wherein the closure member can assume a position of the lower valve seat being closed and the upper valve seat being open and alternatively the closure member can assume a position of the lower valve seat being closed and the upper valve seat being open, wherein the first recited position provides a connection from the second pressure-fluid connector via an annular space around the lower valve seat and passing the magnet coil upwardly to the third pressure-fluid connector such that the conduit leading into the cylinder head is thus vented from the cylinder bore of the linear unit in the first position of the valve and that where the closure member is deflected upwardly by actuation of the magnetic coil, then the upper valve seat becomes closed and the lower valve seat opens and the pressure fluid can enter into the valve via the first pressure-fluid connector and passes via the annular space into the second pressure-fluid connector in order to subject from there the recited cylinder borehole to pressure in this position of the valve;

a second swivelling screw fitting, wherein the second swivelling screw fitting is connected at the flange in order to allow a capturing of the exhaust air, and also in order to connect a tubing for the discharge of the exhaust air from any desired circumferential position;

wherein the swivelling screw fitting is swivelled relative to the casing;

a thread disposed at the bottom side of the valve and serving for screwing the valve into the cylinder head;

a connection cable for supplying of the magnet coil with electrical power;

deflection means disposed on the outside relative to the cylinder;

a flexible rope fed through a seal and through the two cylinder heads and connecting the piston at its two front faces and wherein the flexible rope is guided by the deflection means and wherein the rope is connected at the outside of the cylinder with a slider;

wherein the slider runs in an opposite direction to the piston at the outside of the cylinder;

a switching box disposed at the outside of the cylinder at a position of half the axial length of the cylinder, wherein the switching box is subdivided into a pneumatic plane and into an electric plane for furnishing electrical and pneumatic switch connections;

first fluid pressure connector attached to the valve, wherein the pneumatic plane is connected through short tubing pieces to the first pressure-fluid connectors, wherein the first fluid pressure connector is screwed into a head of the cylinder and wherein the swivelling screw fitting is directed inwardly toward the switching box such that the tubing pieces are short and bent only by a minimum angle;

a cable led from the valves to the electrical plane of the switching box, wherein one single supply tubing is connecting the pneumatic plane of the switching box to a central unit and wherein only one single supply cable is connecting the electric plane to a central unit;

a sound absorber attached to the valve for sound absorbing and sound damping;

a throttle connected to the sound absorber;

an electronic control system furnished in the electric plane of the switching box, wherein the proper electronic control comprises a specific operating program for the valve; display means connected to the electric plane of the switching box for indicating the operating state of the linear unit;

a power supply for the valve;

a proximity switch disposed at the linear unit for recognizing end positions of the slider and for avoiding collisions of the linear unit with other units of a manipulating device and wherein the proximity switch is connected to the power supply for the valves;

a supply cable connecting the proximity switch to the central unit for delivering the measurement signal top the central unit;

a pressure discharge port connected to the valve;

a throttle attached to the pressure discharge port for allowing to set the drive speed of the piston;

a sound absorber connected downstream relative to the throttle;

a packing plate attached to the armature for providing a seal to the valve seat;

a screw connection attached to the swivelling screw fitting;

a stop disposed at the swivelling screw fitting and wherein a narrowing of the diameter at the position of attachment to the swivelling screw fitting for preventing contaminating material from entering; and a magnet coil maintained in a fixed position based on such a narrowing of the diameter at the position of attachment in the area of the swivelling screw fitting.

25. The linear unit according to claim 1, wherein the cylinder includes a casing, which casing is connected at its bottom side, by way of an upper rotary connector, to a corresponding rotary connector of the swivelling screw fitting;

a flange disposed at the upper end of the casing;

an upper valve seat disposed at the upper end of the casing, wherein the upper valve seat is part of the flange;

a lower valve, wherein the valve seat is integrated into the swivelling screw fitting;

a lower rotary connector connected to the swivelling screw fitting and to a lower cylinder head formed at the swivelling screw fitting for rotating the swivelling screw fitting around a longitudinal axis of the linear unit and relative to an upper cartridge part and to the cylinder head;

a bias spring;

a closure member formed as a movable magnet armature;

a magnet coil engaged by the bias spring and deflecting the closure member in an axial direction against the force of the bias spring;

a first pressure-fluid connector exiting radially on a side of the swivelling screw fitting and allowing an inflow of a pressure fluid toward the seat of the valve;

a lower rotary connector;

a second pressure-fluid connector running downwardly from the swivelling screw fitting through the lower rotary connector and allowing feeding of a pressure fluid toward a cylinder head;

a third pressure-fluid connector formed by an upper flange of a cartridge for discharging and venting of a pressure fluid;

wherein the closure member can assume a position of the lower valve seat being closed and the upper valve seat being open and alternatively the closure member can assume a position of the lower valve seat being closed and the upper valve seat being open, wherein the first recited position provides a connection from the second pressure-fluid connector via an annular space around the lower valve seat and passing the magnet coil upwardly to the third pressure-fluid connector such that the conduit leading into the cylinder head is thus vented from the cylinder bore of the linear unit in the first position of the valve and that where the closure member is deflected upwardly by actuation of the magnetic coil, then the upper valve seat becomes closed and the lower valve seat opens and the pressure fluid can enter into the valve via the first pressure-fluid connector and passes via the annular space into the second pressure-fluid connector in order to subject from there the recited cylinder borehole to pressure in this position of the valve;

a second swivelling screw fitting, wherein the second swivelling screw fitting is connected at the flange in order to allow a capturing of the exhaust air, and also in order to connect a tubing for the discharge of the exhaust air from any desired circumferential position;

wherein the swivelling screw fitting is swivelled relative to the casing;

a thread disposed at the bottom side of the valve and serving for screwing the valve into the cylinder head;

a connection cable for supplying of the magnet coil with electrical power;

deflection means disposed on the outside relative to the cylinder;

a flexible rope fed through a seal and through the two cylinder heads and connecting the piston at its two front faces and wherein the flexible rope is guided by the deflection means and wherein the rope is connected at the outside of the cylinder with a slider;

wherein the slider runs in an opposite direction to the piston at the outside of the cylinder;

a switching box disposed at the outside of the cylinder at a position of half the axial length of the cylinder, wherein the switching box is subdivided into a pneumatic plane and into an electric plane for furnishing electrical and pneumatic switch connections;

first fluid pressure connector attached to the valve, wherein the pneumatic plane is connected through short tubing pieces to the first pressure-fluid connectors, wherein the first fluid pressure connector is screwed into a head of the cylinder and wherein the swivelling screw fitting is directed inwardly toward the switching box such that the tubing pieces are short and bent only by a minimum angle;

a cable led from the valves to the electrical plane of the switching box, wherein one single supply tubing is connecting the pneumatic plane of the switching box to a central unit and wherein only one single supply cable is connecting the electric plane to a central unit;

a sound absorber attached to the valve for sound absorbing and sound damping;

a throttle connected to the sound absorber; an electronic control system furnished in the electric plane of the switching box, wherein the proper electronic control comprises a specific operating program for the valve; display means connected to the electric plane of the switching box for indicating the operating state of the linear unit;

a power supply for the valve;

a proximity switch disposed at the linear unit for recognizing end positions of the slider and for avoiding collisions of the linear unit with other units of a manipulating device and wherein the proximity switch is connected to the power supply for the valves;

a supply cable connecting the proximity switch to the central unit for delivering the measurement signal top the central unit;

a pressure discharge port connected to the valve; a throttle attached to the pressure discharge port for allowing to set the drive speed of the piston;

a sound absorber connected downstream relative to the throttle;

a packing plate attached to the armature for providing a seal to the valve seat;

a screw connection attached to the swivelling screw fitting; a stop disposed at the swivelling screw fitting and wherein a narrowing of the diameter at the position of attachment to the swivelling screw fitting for preventing contaminating material from entering; and a magnet coil maintained in a fixed position based on such a narrowing of the diameter at the position of attachment in the area of the swivelling screw fitting.

* * * * *